United States Patent [19]

Bohmer

[11] Patent Number: 4,658,188

[45] Date of Patent: Apr. 14, 1987

[54] APPARATUS AND METHOD FOR SCANNING A FLAT SCREEN CATHODE RAY TUBE

[75] Inventor: William Bohmer, Flanders, N.J.

[73] Assignee: Control Interface Company Limited, Randolph, N.J.

[21] Appl. No.: 700,320

[22] Filed: Feb. 11, 1985

[51] Int. Cl.[4] ..... H01J 29/70

[52] U.S. Cl. ..... 315/366; 313/422

[58] Field of Search ..... 315/366; 313/422, 411, 313/413, 436

[56] References Cited

U.S. PATENT DOCUMENTS 3,890,541 6/1975 McCarthy et al. ..... 315/366

4,484,103 11/1984 Credelle ..... 315/366

*Primary Examiner*—Theodore M. Blum

*Assistant Examiner*—Gregory C. Issing

*Attorney, Agent, or Firm*—Kenyon & Kenyon

[57] ABSTRACT

The disclosure relates to an apparatus and method for forming a scanning electron beam for use in a flat screen cathode ray tube device. An analog addressing method enables scanning of one axis of the screen of the CRT device. During scanning, all portions of a sheet of electrons emitted by a line cathode are deflected at any given time and blocked by an analog horizontal-positioning deflection grid except for one narrow portion disposed along the length of the line cathode. At the one portion, a narrow beam of electrons is formed. The grid contains an address plate and a load plate. The load plate creates a voltage gradient causing each location along its horizontal axis to be at a distinct voltage. Horizontal scanning is accomplished by applying a varying central voltage to the address plate. This varying voltage will be matched by an equal voltage at a single predetermined location along the horizontal axis of the load plate adjacent to which electrons can pass undeflected in the form of a beam. At all other locations along the horizontal axis, unequal voltages on the plates deflect electrons in the sheet passing between them and cause the electrons to be blocked. Vertical scanning is accomplished by varying the voltage difference between two parallel vertical deflection plates between which the scanned electron beam passes. The disclosure also relates to the use of electromagnetic rather than electrostatic deflections in producing a scanning electron beam from a line cathode. In addition, the disclosure relates to multiple beams for scanning and producing of color images.

42 Claims, 16 Drawing Figures

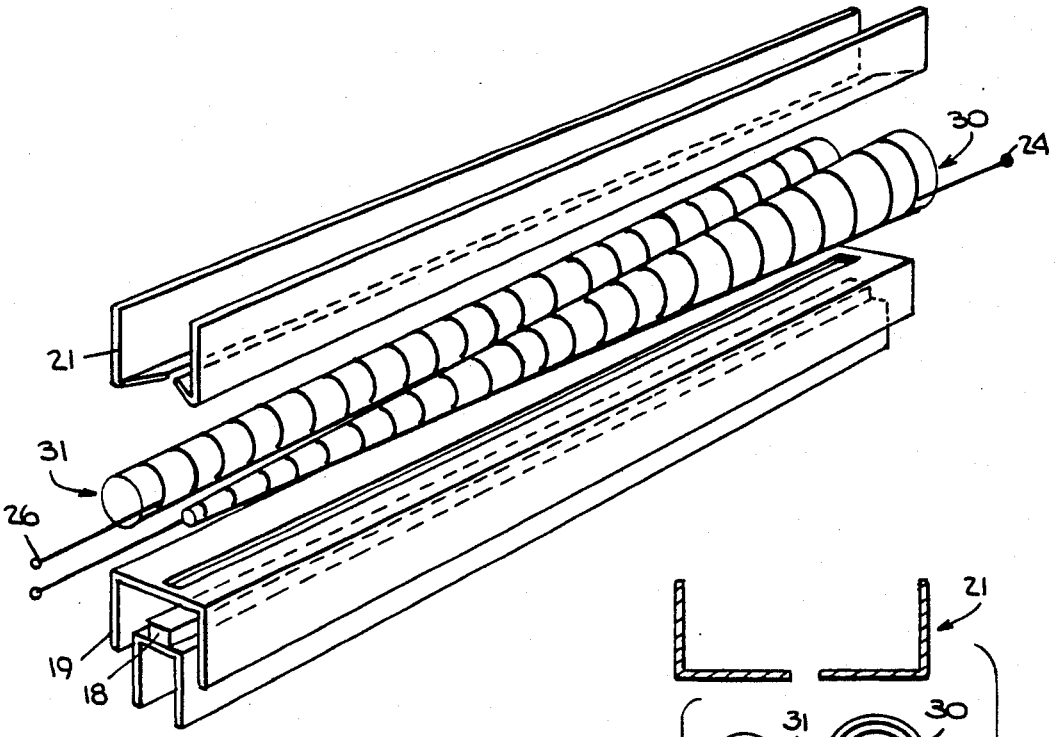
Fig. 7.
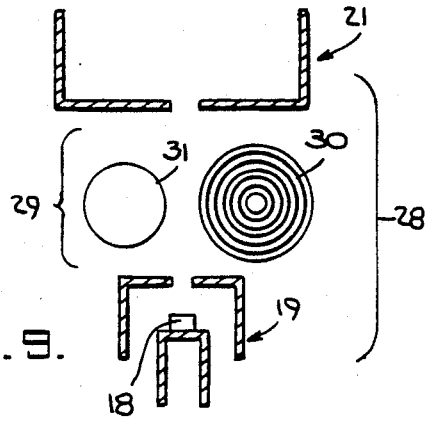
Fig. 9.
Fig. 8.
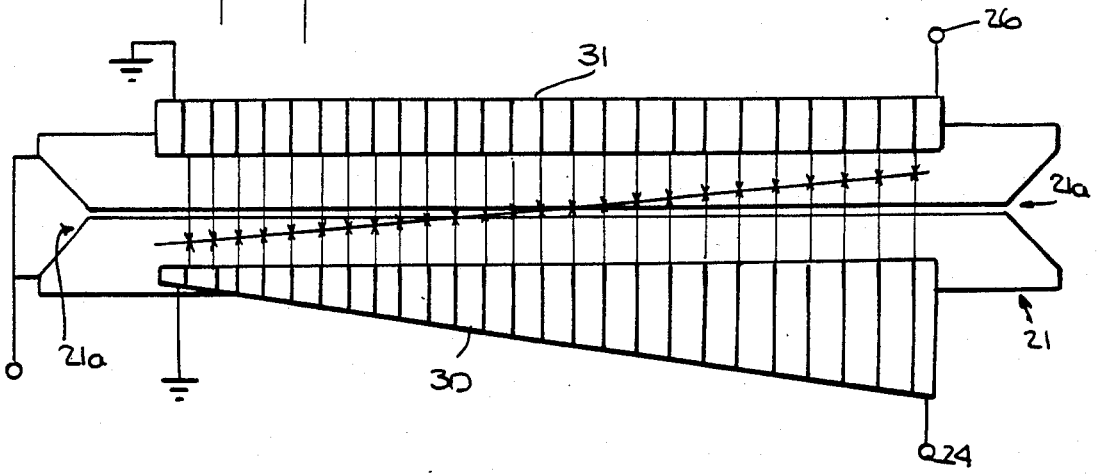

APPARATUS AND METHOD FOR SCANNING A FLAT SCREEN CATHODE RAY TUBE

BACKGROUND OF THE INVENTION

1. Field of the Invention

The invention relates to an apparatus and method for forming a scanning electron beam for a cathode ray tube device. More particularly, the invention relates to an apparatus and method for forming a scanning electron beam for a flat screen cathode ray tube device.

Flat screen cathode ray tube devices have been the subject matter of investigations, research and development for many years since a flat screen potentially eliminates the bulk of the envelope of a conventional cathode ray tube, especially a television picture tube. A conventional cathode ray tube, due to the geometry of scanning from an electron gun extending at right angles to the screen, results in a comparatively long neck extending away from the rear portion of the tube. Shortening the neck by moving the gun toward the screen complicates the compensation necessary to eliminate distortion and loss of focus due to the difference in distances between the gun and the center of the screen as compared to the extreme edges of the screen. The length of the neck of a conventional tube is a problem with a small portable set; however, if a truly large screen is desired, for example greater than 30 inches on the diagonal, the bulk of the picture tube resulting from the gun and neck structure becomes overwhelming.

Efforts to develop flat screen tubes to avoid these problems have met with only limited success. Flat screen tubes which are scanned by a single gun or multiple guns emitting electron beams parallel to the surface of the screen have presented complex problems in achieving linear scans with uniform focusing and without distortion. Attempts to use line cathodes and driven grid structures to achieve a limited number of parallel beams for scanning have resulted in extremely complex structures. These problems have been compounded in attempts to provide flat screen picture tubes for providing visual images in color.

2. Description of the Prior Art

Cathode ray tube ("CRT") devices having flat screens are known in the prior art as well as the provisions of elongated or line cathodes in such CRT devices. U.S. Pat. Nos. 4,449,148, 4,451,846 and 4,451,852 each show a flat CRT screen and a plurality of line cathodes. Line cathodes are also shown in U.S. Pat. Nos. 4,429,251, 4,435,672, 4,437,044 and 4,484,103.

The line cathode of U.S. Pat. No. 2,858,464 utilizes perforated grids, the holes of which define the number of electron beams which can be produced from the line cathode. Deflection coils taken with the perforated grids enable a scan of an electron beam to be formed along the length of the line cathode. A middle grid may include a long slit, rather than holes.

In U.S. Pat. No. 3,531,681, emission control grids in conjunction with a slotted emission control plate form a scanning electron beam from the electrons emitted by a line cathode.

In U.S. Pat. No. 4,028,582, there is provided a number of channels or beam guides for deflecting an electron beam from a line cathode in a direction transverse to the beam to produce a segment of a total line scan. Each adjacent channel continues the formation of a total line scan. The beam from the line cathode can be formed in accordance with U.S. Pat. No. 2,858,464.

SUMMARY OF THE INVENTION

It is an object of the invention to provide an apparatus and method for scanning a flat screen cathode ray tube device.

It is another object of the invention to provide an apparatus and method for forming a scanning electron beam from a line or strip cathode.

It is a further object of the invention to provide a sequence of electron beams extending parallel to one another from a line cathode for scanning a flat screen.

It is an additional object of the invention to use an analog address signal for forming an electron scanning beam from a line cathode.

It is also an object of the invention to provide a flat screen cathode ray tube having a line cathode providing a scanning electron beam for one axis of the screen and a plate electrode for providing scanning of the electronic beam in the other axis of the screen.

It is still another object of the invention to provide a scanning electron beam for a flat screen cathode ray tube device adapted to provide a visual image in color.

The invention relates to a flat panel cathode ray tube ("CRT") display in which the scanning of one axis of the screen of the CRT device is accomplished by an analog addressing method. The method of analog addressing of the flat cathode ray tube simplifies electron beam formation and scanning by eliminating the requirement of complex scanning techniques and the constructions of prior art flat screen CRT displays. In accordance with the invention, a narrow electron beam is formed from a line cathode by deflecting most of the emitted electrons. Thus, a sheet or layer of emitted electrons extends parallel to the plane of the flat screen. An analog horizontal-positioning deflection grid is adapted to deflect all portions of the sheet of electrons and prevents them from passing to the screen except for electrons emitted from an instantaneous single location along the horizontal axis of the ribbon cathode. The analog horizontal-positioning deflection grid controls emission from a single location by an analog nulling system. The horizontal-positioning deflection grid, which is elongated, extends parallel to the ribbon cathode and the control grid and contains two deflection plates. The address and load plates are separated by a very narrow gap such that a slight deflection of the electron beam prevents the beam from passing between the plates. The load plate can be in the form of an elongated linear resistor. A constant voltage is placed across the load plate in order that a voltage gradient exists along the length of the load plate, thereby causing each location along the horizontal axis to be at a distinct voltage. The address plate can be a substantially nonresistive elongated plate facing the load plate in order that any voltage applied to the address plate is established uniformly along its entire length.

Horizontal scanning is accomplished by applying a varying control voltage to the address plate. If the control voltage is at any level between the highest and lowest voltage levels occurring at the ends of the resistive load plate, this voltage will be matched by an equal voltage at a single point along the length of the load plate. Since the voltages on the load and address plates are equal at one point along the horizontal axis of the plates, an electron beam emitted between the load plate and the address plate at that horizontal position cannot be deflected and thus will pass through the horizontal-positioning deflection grid. At all other locations on the horizontal axis, the voltages on the load plate and the address plate are unequal, causing the sheet of electrons passing through the gap between the plates to be deflected against one of the plates, thereby blocking or absorbing the entire sheet of electrons except for the narrow beams of electrons. This narrow beam exits the horizontal-positioning deflection grid and is accelerated by an elongated high voltage anode in an acceleration grid. The electron beam moves adjacent the viewing area of the display at a predetermined horizontal location.

The beam is required to excite the phosphor on the viewing plate at the precise vertical location. The vertical deflection plates contain two parallel plates. The viewing plate is coated with a phosphor screen and has a transparent electrode on its inner surface. The back plate has a uniformly conductive electrode on its inner surface and is kept at a constant voltage. By controlling the voltage on the transparent electrode of the viewing plate, the amount of deflection of the narrow electron beam is controlled and thereby the electron beam can be made to impact the phosphor screen on the viewing plate at a horizontal scan line disposed at a predetermined vertical location. Thus, a raster scan is obtained as the voltages on the address plate and viewing plate are varied to move the beam horizontally and vertically, respectively.

BRIEF DESCRIPTION OF THE DRAWINGS

For a fuller understanding of the invention, reference is had to the following description taken in connection with the accompanying drawings in which:

FIG. 7 is a fragmentary perspective view of an analog scanning system in which the analog horizontal-positioning deflection grid utilizes electromagnetic fields;

FIG. 8 is a schematic representation of the regions between the address coils and the load coils of the analog horizontal-positioning deflection grid where the electromagnetic field is zero; and FIG. 9 is a fragmentary section view of an analog scanning system in which the analog horizontal-positioning deflection grid uses electromagnetic coils.

DETAILED DESCRIPTION OF THE PREFERRED EMBODIMENT

Figure 1:
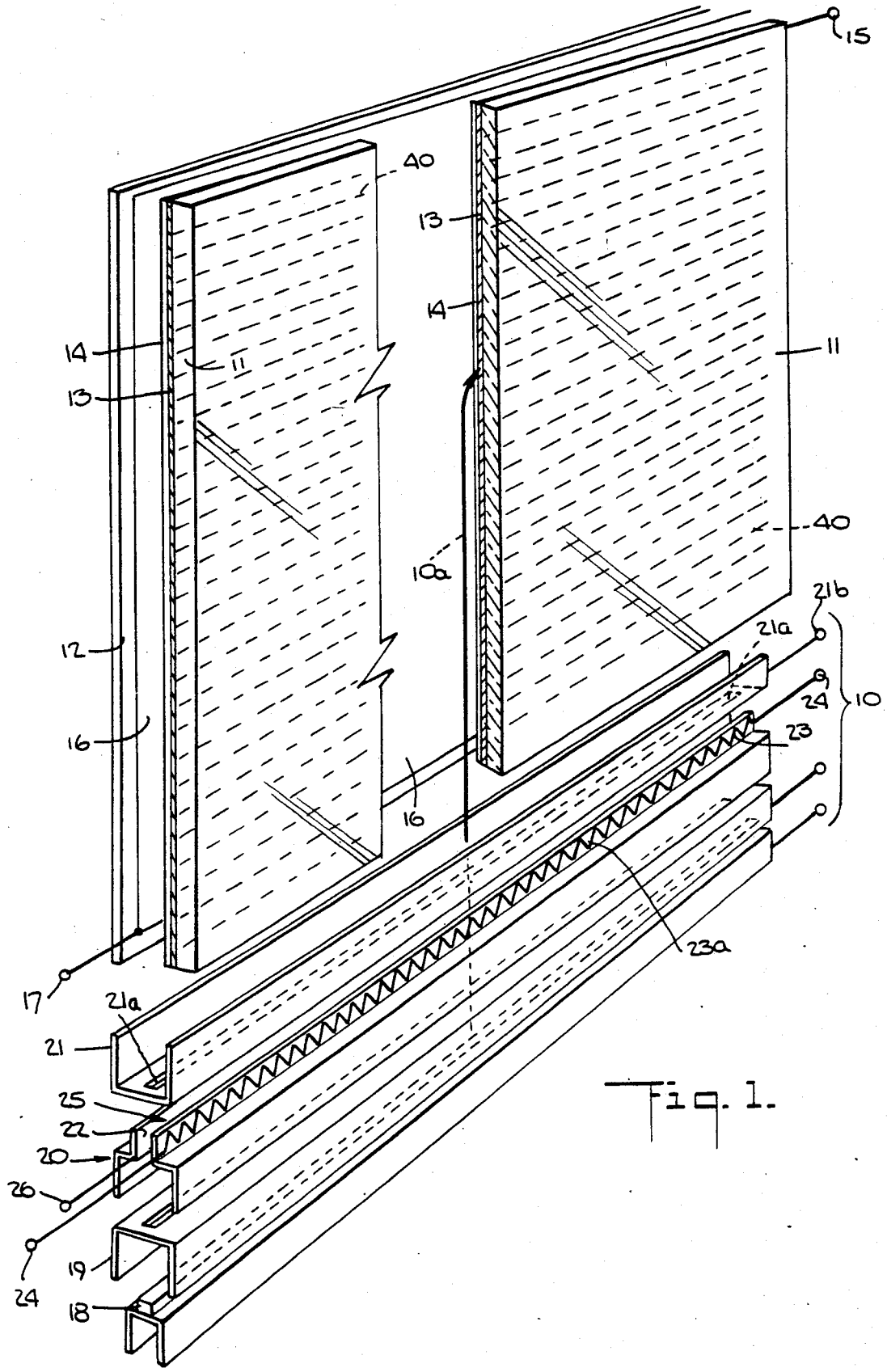
FIG. 1 is a perspective view of the deflection plates and an analog scanning system for a flat screen CRT.

The flat cathode ray tube ("CRT") of the invention as shown in FIG. 1 comprises a system 10 for forming a scanning electron beam 10*a*. The system comprises two vertical deflection plates which are a transparent viewing plate 11 and a back plate 12. On the inner surface of the viewing plate 11 is disposed a transparent substantially non-resistive electrode 13 in the form of a sheet. A suitable material for the transparent electrode 13 is a thin layer of tin oxide, which can readily be deposited on the surface of a plate. Electrode 13 which is transparent and substantially non-resistive is deposited in the form of a strip or sheet extending across plate 11. A phosphor coating 14 is applied to the inner surface of the transparent electrode 13 on the viewing plate 11. The phosphor coating 14 becomes perceptibly luminescent when impacted by and excited by an electron beam, as is well known by those skilled in the art of CRT devices. The transparent electrode 13 is connected to a first lead 15 which enables a variable voltage to be placed on the viewing plate 11.

The back plate 12 is substantially parallel to the viewing plate 11 and has a conductive electrode 16 such as an electrode of metallic material disposed on the inner surface of back plate 12 in the form of a sheet. The metal electrode 16 which is substantially non-resistive is connected to a second lead 17 that enables a fixed voltage from a voltage source to be placed on the back plate 12.

The analog system 10 for forming a scanning electron beam 10*a* in FIGS. 1–4 forms the electron beam and also controls, focuses, deflects, and converges the electron beam. The system 10 additionally enables horizontal scanning of the electron beam by changing the horizontal position of the electron beam. The system 10 of the invention comprises a line or strip cathode 18, a control grid 19, an analog horizontal-positioning deflection grid 20, and an acceleration grid 21. The line cathode 18 which is disposed along a predetermined line is the source of electrons which are emitted in the form of a sheet of electrons extending at right angles to the predetermined line. The electrons then pass through the control grid 19 and an electron beam in the form of a horizontal sheet emerges. The control grid, like the ribbon cathode 18, is elongated and extends parallel to the cathode. The control grid receives the intensity signal which can modulate the intensity of the electron beam. In the case of a television tube, the control grid can receive a video signals. In this way, the intensity with which the electron beam eventually impacts on the phosphor coating 14 of the viewing plate 11 can be controlled by using the control grid 19 to modulate the intensity of the electron beam.

The electron beam in the form of a horizontal sheet then reaches the electrostatic analog horizontal-positioning deflection grid 20. Grid 20 which is elongated extends parallel to the ribbon cathode 18 and the control grid 19. The deflection grid 20 comprises an address plate 22 and a load plate 23. The load plate 23 of deflection grid 20 comprises means for applying a referencing field to the sheet of emitted electrons which extends with respect to the plane of the sheet of electrons. The address plate 22 of deflection grid 20 comprises the means for generating a scanning field. The address and load plates are separated by a very narrow gap in order that slight deflection of electrons of the sheet passing through the gap will cause the deflected electrons of the sheet to be blocked or absorbed by the horizontal-positioning deflection grid 20.

Figure 5:
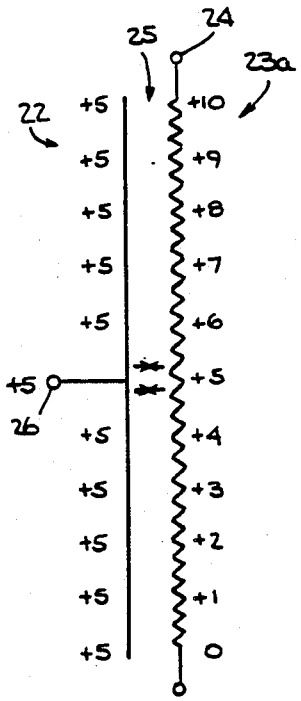
FIG. 5 is a schematic representation of the electrical potential between the address plate and the load plate of the analog horizontal-positioning deflection grid.

The elongated load plate 23 is in the form of an impedance element such as, for example, a linear resistor 23*a* which is connected by means of load leads 24 to a source of a constant voltage. The applying of a constant voltage at the ends of the load plate 23 creates a voltage gradient along the horizontal length of plate 23 as current passes through the linear resistance. A distinct voltage is thus present at each separate location along the horizontal length of load plate 23. (FIG. 5). As a result, the voltage gradient along the resistor 23*a* forms an electric field having a corresponding gradient.

The address plate 22 extends parallel to the load plate 23 with a thin horizontal gap 25 between them through which only an undeflected electron beam can pass. The gap 25 is parallel to and is in alignment with the predetermined line along which line cathode 18 is disposed. The distinct voltages along the load plate 23 cause an electrostatic field to be exerted on any charged particles, i.e. electrons, passing through the horizontal gap 25 between the address plate 22 and the load plate 23.

The address plate 22 is connected by means of address leads 26 to a varying scanning voltage. The address plate 22 is substantially non-resistive so that a voltage applied to address plate 22 exists uniformly along its horizontal length (FIG. 5). The varying scanning voltage when applied to the address plate 22 causes an electrostatic field to be exerted on charged particles in horizontal gap 25. The electrostatic fields generated by the address and load plates which interact across the gap are in opposite directions.

Figure 2:
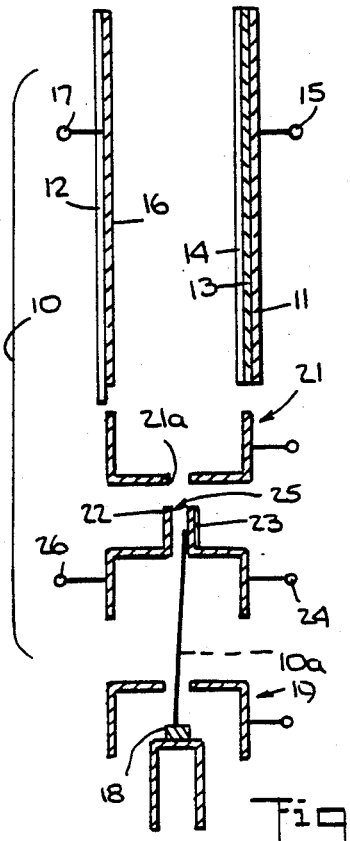
FIG. 2 is a schematic representation of an electron beam emitted by the analog scanning system and impacting on the screen of the CRT.
Figure 3:
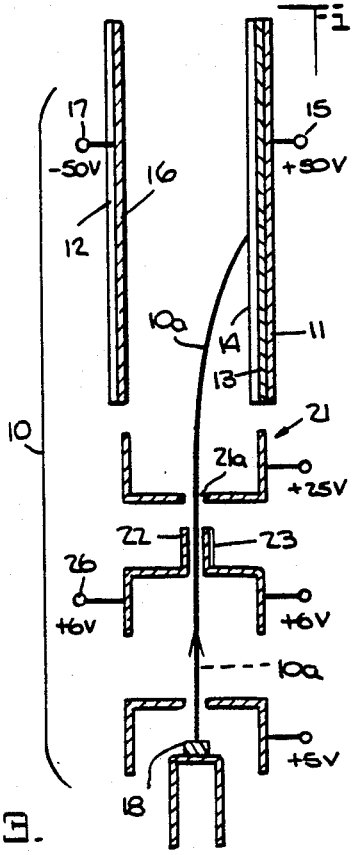
FIG. 3 is a schematic representation of an electron beam blocked or absorbed at one side by the analog horizontal-positioning deflection grid.
Figure 4:
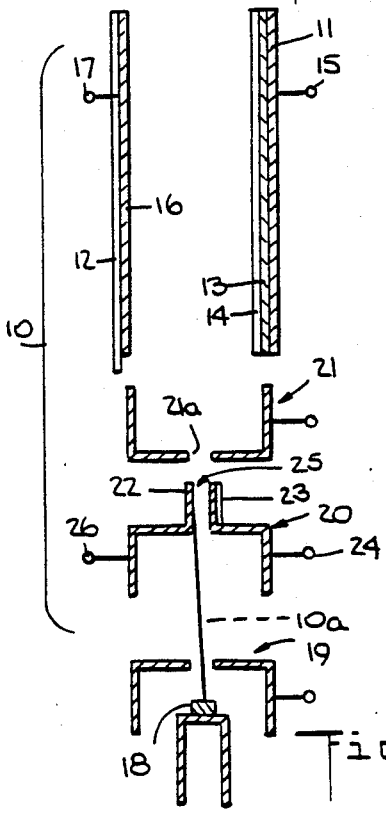
FIG. 4 is a representation of an electron beam blocked or absorbed at an opposite side by the analog horizontal-positioning deflection grid.

As shown by the arrows in FIG. 5, the electrostatic field across the gap 25 created by the load plate 23 varies linearly while the force created by the address plate 22 is uniform. An electron passing through the horizontal gap 25 between the plates will be deflected by the resultant of the interacting electrostatic fields and will be blocked or absorbed by the analog horizontal-positioning deflection grid 20 at any points along the length of horizontal gap 25 where the interacting electrostatic fields from the plates do not cancel each other out (FIGS. 3 and 4). As long as a voltage at some level between the highest and lowest voltage levels at the ends of the load plate 23 is selected and applied to the address plate 22 through address leads 26, there will always be one point along the length of horizontal gap 25 where the resultant electrostatic field exerted on the electron beam is zero (FIGS. 2 and 5). Thus, the sheet of electrons entering the analog horizontal-positioning deflection grid 20 will be completely blocked except for the narrow beam of electrons which are not deflected at the zero point. The zero point is controlled to be at a single horizontal location by varying the voltage applied to the address plate 22. Accordingly, the analog scanning system 10 of the invention can be used to form a scanning electron beam 10*a* by cutting off the emission of electrons by the ribbon cathode 18 except for a narrow electron beam at one horizontal location.

The narrow beam at a single horizontal position emerging from the deflection grid 20 then passes through the horizontal slot 21*a* in acceleration grid 21 (FIGS. 1 and 2). The acceleration grid 21 is an elongated high voltage anode which is parallel to the ribbon cathode 18, control grid 19 and deflection grid 20. Grid 21 by virtue of the anode voltage applied thereto by terminal 21*b* accelerates the narrow electron beam 10*a*. If desired, the electron beam can then be passed through a focusing electrode (not shown) to enhance the focusing of beam 10*a* before entering the region between the viewing plate 11 and back plate 12.

Figure 6:
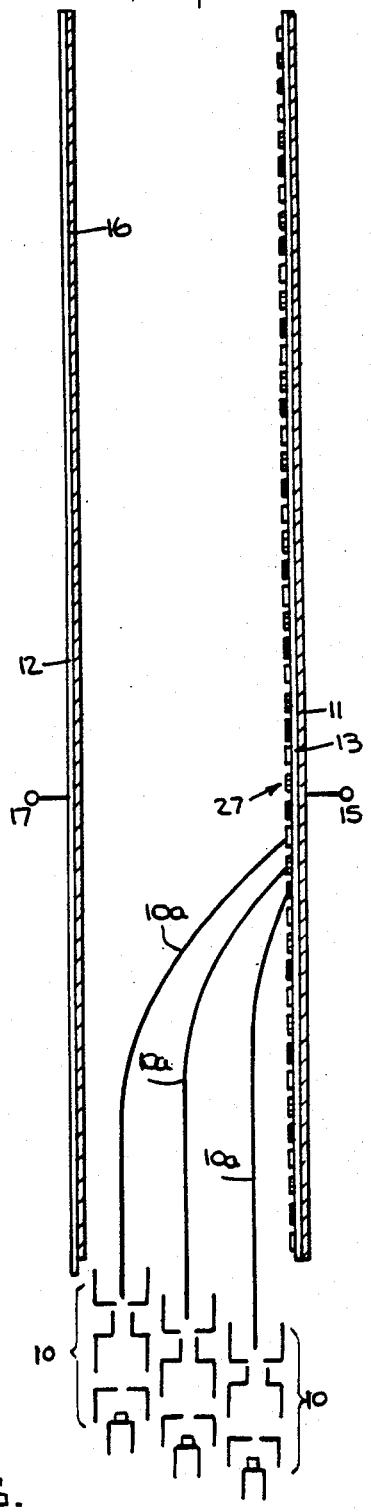
FIG. 6 is a schematic view of an array of electron beams of an analog scanning system for forming color images.
Figure 10:
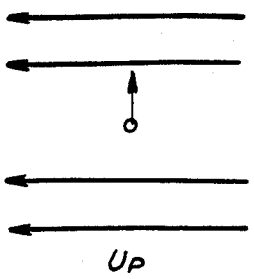
FIGS. 10 and 11 show the upward and downward movement respectively, of an electron moving out of the paper and with respect to the fields of coils 30 and 31, the direction of the fields being shown by arrows.
Figure 11:
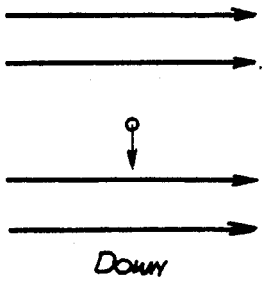
Figure 12:
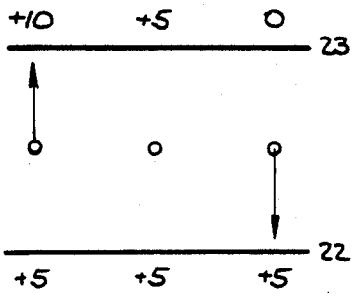
FIGS. 12–16 show the movement of electrons in various different electrostatic field between plates 22 and 23, the electrons being shown as moving toward the more positive voltage.
Figure 13:
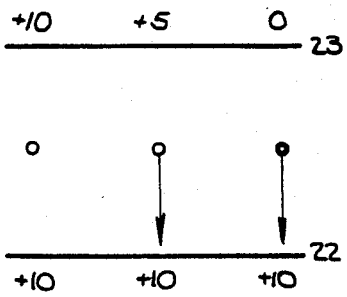
Figure 14:
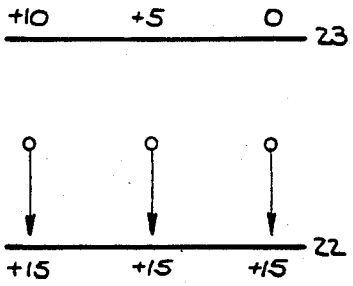
Figure 15:
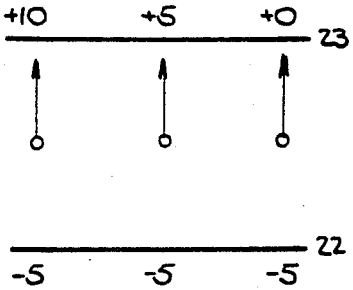
Figure 16:
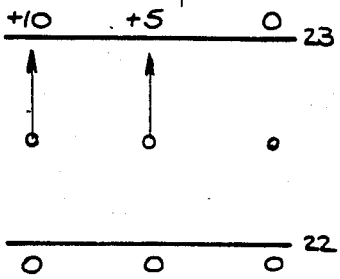

After emerging from the analog scanning system 10, the horizontally-positioned narrow electron beam enters the region between the viewing plate 11 and back plate 12 where the beam is electrostatically deflected to achieve vertical scanning of the screen. Thus, the level of the electrostatic field across plate 11 and plate 12 controls the curvilinear path of beam 10*a* as shown in FIGS. 2 and 6 and thereby the position of the horizontal scan lines of the raster on plate 11. As shown in FIGS. 1 and 2, the vertical deflection plates 11 and 12 described previously have voltages applied to them. A fixed voltage is applied to the metal electrode 16 on back plate 12 by means of lead 17. A variable voltage is applied to the transparent electrode 13 on viewing plate 11 by lead 15. Different voltages on the viewing plate 11 and back plate 12 create an electric field which electrostatically deflects the path of the electron beam. Progressively varying the voltage difference between the vertical deflection plates, by progressively changing the voltage on transparent electrode 13, causes change of the position of the scan lines 40 (FIG. 1) upon which the electron beam impacts and excites the phosphor coating 14 on viewing plate 11. Thus, a progressively changing voltage, i.e. a scanning voltage, causes the beam to move vertically along the viewing plate 11 in the form of a vertical scan. Thus, by applying sawtooth or triangular voltage waveforms to the address plate 22 and the transparent electrode 13, the entire area of the viewing plate 11 can be raster scanned by a narrow electron beam.

In an alternative embodiment of the invention shown in FIG. 6, an array of analog scanning systems 10 is used, each having a separate line or ribbon cathode 18. The viewing plate 11 has deposited on its inner surface a series of horizontal lines 27 of different phosphor each of which are adapted to generate a different primary color when excited by electron beam 10*a*. The phosphors are typically selected to emit forms of red, green and blue light. In the full color embodiments of the invention, it is possible to control the particular color of a region as well as the intensity. The spacing between each colored line, as well as between each line of the scan, are selected to be close enough to enable the instantaneous scanned portion of three adjacent lines to combine into a color image of proper fidelity and resolution. The electron beams emerging from each analog scanning system are conditioned to control generation of a single different color in achieving a proper color image. Therefore, the electron beam of each system is conditioned to intersect the lines of phosphor 27 capable of emitting the corresponding color. This is accomplished by staggering the positions of the scanning system 10 with respect to the distance to the screen. As a result, the electrostatic force across the vertical deflection plates causes each beam to impact upon the viewing plate 11 at a slightly different vertical position or scan line corresponding to the spacing between adjacent colored lines on the colored phosphor 27.

The system of the invention for forming a scanning electron beam can also employ electromagnetic deflection as shown in FIGS. 7, 9 and 9. The analog scanning electromagnetic system 28 is similar in appearance and function to the electrostatic electron system 10 except for the configuration of the electromagnetic analog horizontal-positioning deflection grid 29. The deflection grid 29 comprises a load coil 30 and an address coil 31. An electron beam cannot pass through the horizontal slot 21*a* in the acceleration grid 21 if it has been deflected by an electromagnetic force. The address coil 31 is elongated and uniformly wound, e.g. in helical form, about the longitudinal axis thereof. The address coil is adapted to have a variable voltage applied thereto which produces a varying electromagnetic field. The load coil 30 is elongated but is not uniformly wound. For example, the load coil can be in the form of a spiral extended in a conical form as shown in FIGS. 7 and 9. Either the number of turns of wire along the coil form or the size of the coil can vary along its horizontal length in order to create a magnetic field gradient which varies, e.g. linearly, between the ends of the load coil when a fixed voltage is applied to it. The uniform magnetic field from the address coil 31 and the linearly varying magnetic field from the load coil 30 oppose each other in the region between the two coils through which the horizontal sheet of electrons is emitted. By varying the voltage applied to the address coil 31, the point along the horizontal length of the two coils where the magnetic field from the two coils precisely cancels each other can be selected and moved. The electron beam passing through the region where the resultant magnetic field is zero is not subject to any deflecting force and will pass through the slot in the acceleration grid 21. On the other hand, the remainder of the electrons in the sheet of electrons are subjected to a magnetic field having lines of flux extending in a horizontal direction, i.e. in the direction substantially of the longitudinal axis of the coils, which will deflect the electrons to the right or left as shown in FIG. 9, thereby blocking these electrons from moving toward the screen. As a result, a narrow beam of electrons exists at a selected horizontal position, and by varying the voltage on the address coil 31, horizontal scanning of the viewing plate 11 can be achieved, similarly as described above for the case of electrostatic deflection.

Those skilled in the art will recognize other embodiments and modifications of the teachings of the specification that fall within the scope of the invention.

What is claimed is:

1. A system for forming a scanning electron beam comprising:

means for emitting electrons in a plane extending from the length of a predetermined line at substantially a right angle thereto to form a sheet of emitted electrons;

means extending parallel to the predetermined line of the electron emitting means and to the sheet of emitted electrons for applying a reference field extending transverse to the direction of emission of the sheet of emitted electrons;

means disposed adjacent the reference field applying means for generating a scanning field to be applied by the field applying means, the scanning field having a predetermined magnitude extending over the length of the scanning field applying means which is sufficient to deflect the electrons from the plane of the sheet of electrons adjacent the major portion of the length of the scanning field, the resultant field of the reference field and the scanning field having a predetermined magnitude extending over a minor portion of the length of the scanning field applying means which permits the electrons of the portion of the sheet of electrons adjacent to the minor portion to remain as a beam of electrons adjacent the plane of the sheet of electrons, the scanning field having a predetermined rate of scanning of the predetermined magnitude with respect to the length of the scanning field applying means.

2. A system in accordance with claim 1 in which the means for emitting electrons in a plane extending from the length of a predetermined line at substantially a right angle thereto to form a sheet of emitted electrons comprises an elongated cathode extending along the length of the predetermined line.

3. A system in accordance with claim 2 in which the elongated cathode is in the form of an elongated rod.

4. A system in accordance with claim 2 in which the elongated cathode is in the form of a strip.

5. A system in accordance with claim 1 in which each of the means for applying a reference field extending with respect to the sheet of emitted electrons and the means for applying the scanning field comprises a different one of a pair of elongated elements spaced apart substantially parallel to one another to form a slot of predetermined thickness in a direction perpendicular to the plane of the sheet of electrons, the slot being adapted to receive the sheet of emitted electrons therethrough.

6. A system in accordance with claim 5 in which at least one of the pair of spaced apart elongated elements having a slot therebetween comprises an elongated impedance element and an elongated electrode spaced apart from the impedance element, the impedance element when energized applying a reference field to the slot which has a gradient along the length of the impedance element which is a function of the impedance thereof, and in which the means for generating a scanning field to be applied by the scanning field applying means comprises means for applying a scanning signal to the elongated electrode at a frequency corresponding to the scanning rate, the interaction of the reference field having a gradient with the field of the scanning signal providing the predetermined magnitude of the resultant field which enables the electrons of the sheet of electrons adjacent to the minor portion to remain as a beam adjacent the sheet of electrons.

7. A system in accordance with claim 6 in which the elongated impedance element is an elongated resistance element adapted to be energized by a reference voltage and in which the means for applying a scanning signal to the elongated electrode comprises means for delivering a variable voltage to the elongated electrode which varies at the frequency of the scanning rate, the varying voltage when applied to the elongated electrode causing an electric field varying with the varying voltage to be applied to the slot and to the sheet of electrons when received therethrough.

8. A system in accordance with claim 7 in which the interaction of the field having a gradient with the field of the scanning signal when at a predetermined level provides the predetermined magnitude of the resultant field which permits the electrons of the sheet of the electrons adjacent to the minor portion to remain adjacent the sheet of electrons.

9. A system in accordance with claim 8 in which the interaction of the field having a gradient with the field of the scanning signal when at a predetermined level comprises the interaction of a predetermined level substantially corresponding to zero.

10. A system in accordance with claim 1 in which the extent of the minor portion of the length of the scanning field applying means which permits the electrons of the portion of the sheet of electrons adjacent to the minor portion to remain adjacent the plane of the sheet of electrons is that corresponding to a narrow beam of electrons.

11. A system in accordance with claim 6 in which the impedance element has a substantially linear characteristic.

12. A system in accordance with claim 11 in which the impedance element having a linear characteristic has a predetermined slope which enables the interaction of the field having a gradient with the field of the scanning signal to provide the predetermined magnitude of the resultant field which permits a beam of the electrons of the sheet of electrons adjacent to the minor portion to remain adjacent the sheet of electrons.

13. A system in accordance with claim 7 in which the means for delivering a variable voltage to the elongated electrode which varies with frequency of the scanning rate comprises a voltage extending at the scanning rate over a range substantially corresponding to the range of voltages of the elongated impedance element when energized.

14. A system in accordance with claim 13 in which the means for delivering a variable voltage to an elongated electrode which varies with frequency of the scanning rate delivers a variable voltage substantially in the form of a sawtooth having a period corresponding to that of the scanning rate.

15. A system in accordance with claim 5 in which at least one of the pair of spaced apart elongated elements having a slot therebetween comprises a means extending along the length of one of the elongated elements for applying within the slot and parallel with respect to the pair of elongated elements a reference magnetic field having a field strength which varies with a predetermined characteristic along the length of the slot and in which the other of the pair of elongated elements comprises means for applying a scanning magnetic field within the slot and parallel with respect to the pair of elongated elements which is time-varying and substantially uniform in the direction of the length of the slot, the interaction of the magnetic field having a predetermined characteristic and the magnetic field being substantially uniform providing the predetermined magnitude of the resultant field which permits the electrons of the sheet of electrons adjacent the minor portion to remain as a beam adjacent the sheet of electrons.

16. A system in accordance with claim 15 in which the means for applying within the slot and parallel with respect to one of the pair of elongated elements a magnetic field having a field strength which varies with a predetermined characteristic in the direction of the length of the slot comprises a substantially non-linear inductive element disposed adjacent the length of the other elongated element and adapted to direct a magnetic field of substantially varying field strength in the direction of the length of the slot.

17. A system in accordance with claim 16 in which the substantially non-linear inductive element comprises a non-linear winding.

18. A system in accordance with claim 15 in which means for applying a time-varying magnetic field with respect to the slot which is substantially uniform in the direction of the length of the slot comprises a substantially linear inductive element disposed along the length of the other elongated element and adapted to apply within the slot a magnetic field having a substantially uniform magnitude in the direction of the length of the slot.

19. A system in accordance with claim 18 in which the substantially linear inductive element comprises a linear winding.

20. A system in accordance with claim 1 and further comprising means extending adjacent the predetermined line of the means of emitting electrons for electrostatically modulating the emission of electrons.

21. A device in accordance with claim 20 further comprising a control grid extending substantially along the length of the predetermined line of the means for emitting electrons for modulating the emission of electrons.

22. A system in accordance with claim 21 in which the control grid comprises an electrode spaced apart and extending substantially parallel to the predetermined line of the means for emitting electrons and having a slit extending substantially parallel to the predetermined line for receiving the sheet of electrons.

23. A system in accordance with claim 20 in which the control grid is disposed between the means for emitting electrons and the means for generating a scanning field.

24. A system in accordance with claim 1 and further comprising means extending substantially parallel to the predetermined line of the means for emitting electrons for accelerating the electrons of the portion of the sheet of electrons adjacent to the minor portion which remain adjacent the plane of the sheet of electrons.

25. A system in accordance with claim 24 in which the means for accelerating the electrons comprises an electrode extending spaced apart and substantially parallel to the predetermined line of the means for emitting electrons and having an elongated aperture therein extending substantially parallel to the predetermined line of the means for emitting electrons and adapted to receive electrons adjacent to the minor portion which remain as a beam adjacent to the plane of the sheet of electrons.

26. A cathode ray tube device comprising:

a system for forming a scanning electron beam including means for emitting electrons in a plane extending from the length of a predetermined line at substantially a right angle thereto to form a sheet of emitted electrons;

means extending parallel to the sheet of emitted electrons for applying a reference field extending transverse to the direction of emission of the sheet of emitted electrons; and means disposed adjacent the field applying means for generating a scanning field to be applied by the field applying means, the scanning field having a predetermined magnitude extending over the length of the scanning field applying means which is sufficient to deflect the electrons from the plane of the sheet of electrons adjacent the major portion of the length of the scanning field, the resultant field of the reference field and the scanning field having a predetermined magnitude extending over a minor portion of the length of the scanning field applying means which permits the electrons of the portion of the sheet of electrons adjacent to the minor portion to remain as a beam of electrons adjacent the plane of the sheet of electrons, the scanning field having a predetermined rate of scanning of the predetermined magnitude with respect to the length of the scanning field applying means;

means spaced apart from the means for emitting electrons for forming a visual image in response to the electrons of the portion of the sheet of electrons adjacent the minor portion which remain adjacent the plane of the sheet of electrons; and means for deflecting the scanning electron beam in a direction substantially at right angles to the plane of the sheet of electrons to form a two-dimensional image on the image forming means.

27. A cathode ray tube device in accordance with claim 26 in which the means for forming a visual image comprises a screen adapted to produce a visual image in response to an electron beam applied to the surface thereof.

28. A cathode ray tube device in accordance with claim 27 in which the screen is disposed in a plane extending substantially parllel to the plane of the sheet of electrons and away from the means for emitting electrons, and in which the means for deflecting the electrons comprises means for applying a deflection field to deflect the electrons of the portion of the sheet of electrons adjacent to the minor portion which remain as a beam of electrons adjacent the plane of the sheet of electrons to scan the screen along scan lines which extend across the screen substantially parallel to the predetermined line of the means for emitting electrons.

29. A method for forming a scanning electron beam comprising the steps of:

emitting electrons in a plane extending from the length of a predetermined line at substantially a right angle thereto to form a sheet of emitted electrons;

applying a reference field extending transverse to the direction of emission of the sheet of emitted electrons;

generating a scanning field to be applied to the plane of the sheet of emitted electrons transverse to the direction of emission of the sheet of electrons, and overlapping the reference field, the scanning field having a predetermined magnitude extending over a major portion of the length of the scanning field which is sufficient to deflect the electrons from the plane of the sheet of electrons adjacent the major portion of the length of the scanning field, the resultant field of the reference field and the scanning field having a predetermined magnitude extending over a minor portion of the length of the scanning field which permits the electrons of the portion of the sheet of electrons adjacent to the minor portion to remain as a beam of electrons adjacent the plane of the sheet of electrons, the scanning field having a predetermined rate of scanning of the predetermined magnitude with respect to the length of the scanning field.

30. A method in accordance with claim 29 in which the steps of applying a reference field and generating a scanning field extending transversely with respect to the direction of emission of the sheet of emitted electrons comprises applying the reference field and scanning field between a pair of elongated elements spaced apart substantially parallel to one another to form a slot of predetermined thickness in a direction perpendicular to the direction of the sheet of electrons, the slot being adapted to receive the sheet of emitted electrons therethrough.

31. A method in accordance with claim 30 in which at least one of the pair of spaced apart elongated elements having a slot therebetween includes an elongated impedance element and an elongated electrode spaced apart from the impedance element, the method further comprising the step of energizing the impedance element to apply a reference field to the slot which has a gradient along the length of the impedance element which is a function of the impedance element, and in which the step of generating a scanning field comprises applying a scanning signal to the elongated electrode at a frequency corresponding to the scanning rate, the interaction of the reference field having a gradient with the field of the scanning signal providing the predetermined magnitude of the resultant field which enables the electrons of the sheet of electrons adjacent to the minor portion to remain as a beam adjacent the sheet of electrons.

32. A method in accordance with claim 31 in which the elongated impedance element is an elongated resistance element adapted to be energized by a reference voltage and in which the step of applying a scanning signal to the elongated electrode comprises delivering a variable voltage to the elongated electrode which varies at the frequency of the scanning rate, the varying voltage when applied to the elongated electrode causing a resultant field varying with the varying voltage to be applied to the slot and to the sheet of electrons when received therethrough.

33. A method in accordance with claim 32 in which the interaction of the reference field having a gradient with the field of the scanning signal when at a predetermined level providing the predetermined magnitude of the resultant field which permits the electrons of the sheet of the electrons adjacent to the minor portion to remain as a beam adjacent the sheet of electrons.

34. A method in accordance with claim 33 in which the interaction of the reference field having a gradient with the field of the scanning field when at a predetermined level comprises the interaction of a predetermined level substantially corresponding to zero.

35. A method in accordance with claim 29 in which the extent of the minor portion of the length of the scanning field which permits the electrons of the portion of the sheet of electrons adjacent to the minor portion to remain as a beam adjacent the plane of the sheet of electrons is that corresponding to a substantially narrow beam of electrons.

36. A method in accordance with claim 31 in which the impedance element has a substantially linear characteristic.

37. A method in accordance with claim 31 and further comprising the step of providing the impedance element with a linear characteristic having a predetermined slope which enables the interaction of the field having a gradient with the field of the scanning signal to provide the predetermined magnitude of the resultant field which permits a beam of the electrons of the sheet of electrons adjacent to the minor portion to remain adjacent the sheet of electrons.

38. A method in accordance with claim 32 in which the step of delivering a variable voltage to the elongated electrode which varies with the frequency of the scanning rate comprises delivering a voltage extending at the scanning rate over a range substantially corresponding to the range of voltages of the elongated impedance element when energized.

39. A method in accordance with claim 38 in which the step of delivering a variable voltage to an elongated electrode which varies with the frequency of the scanning rate comprises delivering a variable voltage substantially in the form of a sawtooth having a period corresponding to that of the scanning rate.

40. A method in accordance with claim 30 and further comprising the steps of applying within the slot and parallel with respect to the pair of elongated elements a reference magnetic field having a field strength which varies with a predetermined characteristic along the length of the slot and applying a scanning magnetic field within the slot and parallel with respect to the pair of elongated elements which is time-varying and substantially uniform in the direction of the length of the slot, the interaction of the magnetic field having a predetermined characteristic and the magnetic field being substantially uniform providing the predetermined magnitude of the resultant field which permits the electrons of the sheet of electrons adjacent the minor portion to remain as a beam adjacent the sheet of electrons.

41. A cathode ray tube device in accordance with claim 28 in which the means for deflecting the electrons comprises a plate electrode spaced apart and extending substantially parallel in a facing relationship with the surface of a screen which is adapted to be scanned by the electrons, the plate electrode being responsive to a scanning voltage applied thereto to scan the electrons with respect to the scan lines of the screen.

42. A cathode ray tube device in accordance with claim 26 adapted to present visual images in color formed by a combination of at least two substantially primary colors comprising a plurality of systems for forming a scanning electron beam for each different primary color to be presented, each of the systems being offset a different amount with respect to the visual image forming means to cause the electron beams thereof during scanning to intersect different portions of the visual image forming means; and in which the visual image forming means is adapted to form visual images of different colors in response to the electron beams of the plurality of systems for forming a scanning electron beam.

* * * * *